US006378136B2

(12) United States Patent
Matsushita

(10) Patent No.: US 6,378,136 B2
(45) Date of Patent: Apr. 30, 2002

(54) DISPOSABLE GOWN

(75) Inventor: Michiyo Matsushita, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 0 days.

(21) Appl. No.: 09/828,190

(22) Filed: Apr. 9, 2001

(30) Foreign Application Priority Data

Apr. 27, 2000 (JP) ..... 2000-128218

(51) Int. Cl.[7] ..... A41D 13/12
(52) U.S. Cl. ..... 2/114; 2/69
(58) Field of Search ..... 2/69, 114, 243.1, 2/105, 106, 108, 85, 93, 115, 113

(56) References Cited

U.S. PATENT DOCUMENTS 4,969,215 A * 11/1990 Burkett ..... 2/114
5,444,871 A * 8/1995 Lopez ..... 2/114
6,115,840 A * 9/2000 Hastings ..... 2/114

FOREIGN PATENT DOCUMENTS

JP 6-207301 7/1994

* cited by examiner

*Primary Examiner*—Gloria M. Hale
(74) *Attorney, Agent, or Firm*—Lowe Hauptman Gilman & Berner, LLP

(57) ABSTRACT

A disposable gown is composed of a basic trunk portion having front and rear trunk regions and both sleeves, wherein the rear trunk region includes first and second rear trunk halves. Collar elements, by which the first and second rear trunk halves may be kept closed is formed from a front collar member attached to the front trunk region and surrounding front half of a neck opening, a first rear collar member attached to the first rear trunk half and surrounding rear half of the neck opening, and a second rear collar member attached to the second rear trunk half and surrounding rear half of the neck opening. Two pairs of engaging fasteners are formed on respective ends of the front collar member and the first and second rear collar members. The engaging fasteners detachably fasten the collar members to each other.

2 Claims, 5 Drawing Sheets

DISPOSABLE GOWN

BACKGROUND OF THE INVENTION

This invention relates to a disposable gown, for example, outerwear for surgical operations, outerwear for patients, sleepwear of patients.

Japanese Patent Application Publication No. 1994-207301A describes a disposable gown comprising a basic trunk portion of which a rear trunk region is divided into right and left halves, and both sleeves attached to the both sides of the upper end of the basic trunk portion which is provided with a first and second tying cords for fastening the basic trunk portion to the wearer's body from its outside.

According to the gown of prior art, fastener members which can be engaged each other are attached to a neckline of each rear trunk half. When the gown is worn, a wearer places the rear trunk halves upon each other so that the rear portion is closed, ties the waist portion by fastening the first and second tying cords together, and closes the collar by engaging fastener members with each other. If no enough area exists between the neckline of the basic trunk portion and the wearer's neck, although it depends on the size of wearer's neck, tension from the sleeves is transmitted to the upper side of each rear trunk halves. Consequently, the wearer experiences uncomfortable compressive feeling in the vicinity of the wearer's neck and smooth movement of the neck might be restrained by the trunk portion.

SUMMARY OF THE INVENTION

In view of the problem as has been described above, it is an object of this invention to provide a disposable gown improved so that, even if the wearer stretches his or her arms forward or bends his or her elbows, no high pressure of the wear is exerted on the wearer's neck and movement of wearer's neck may be free from restriction by the trunk portion.

According to this invention, there is provided an improvement in the disposable gown comprising a basic trunk portion which has a front trunk region covering the breast and belly of a wearer and a rear trunk region covering the back of the wearer, and both sleeves attached to both sides of an upper end of the basic trunk portion, with a neck opening in the upper end and a hem opening in a lower end of the basic trunk portion, wherein the rear trunk region comprises a first rear trunk half contiguous to one side edge of the front trunk region and a second rear trunk half contiguous to the other side edge of the front trunk region.

The improvement according to this invention is in that a collar element by means of which the first rear trunk half and the second rear trunk half may be kept closed extends along the edge of the neck opening in its circumferencial direction, the collar element being formed from a front collar member attached to the front trunk region and surrounding substantially front half of the neck opening, a first rear collar member attached to the first rear trunk half and extending toward the second rear trunk half so as to surround substantially rear half of the neck opening, and a second rear collar member attached to the second rear trunk half and extending toward the first rear trunk half so as to surround substantially rear half of the neck opening, a first pair of engaging means being formed on respective ends of the front collar member and the first rear collar member faced the second rear collar member, the first pair of engaging means detachably fastening the collar members to each other, a second pair of engaging means being formed on respective ends of the front collar member and the second rear collar member faced the first rear collar member so that the second pair of engaging means may detachably fasten the collar members to each other.

According to one preferred embodiment of this invention, the basic trunk portion and each of the sleeves are formed with a hydrophobic nonwoven fabric or a laminated sheet of hydrophobic nonwoven fabric and a flexible thermoplastic synthetic resin sheet, and the collar element is formed with a hydrophilic nonwoven fabric.

DESCRIPTION OF THE PREFERRED EMBODIMENTS

Details of the disposable gown according to this invention will be more fully understood from the description given hereunder with reference to the accompanying drawings.

Figure 1:
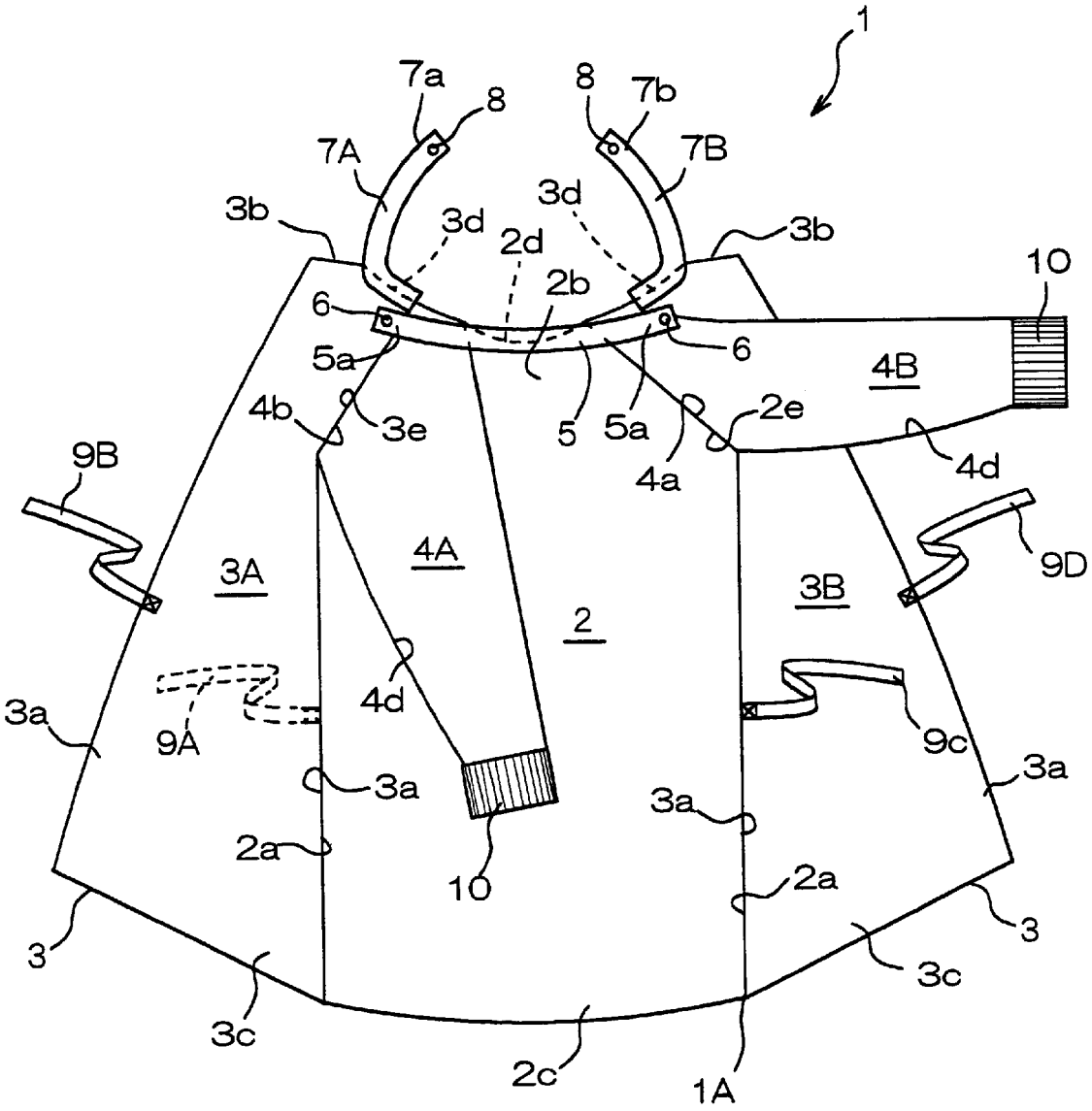
FIG. 1 is a perspective view showing the disposable gown constructed according to the principle of this invention as viewed from the front trunk region.
Figure 2:
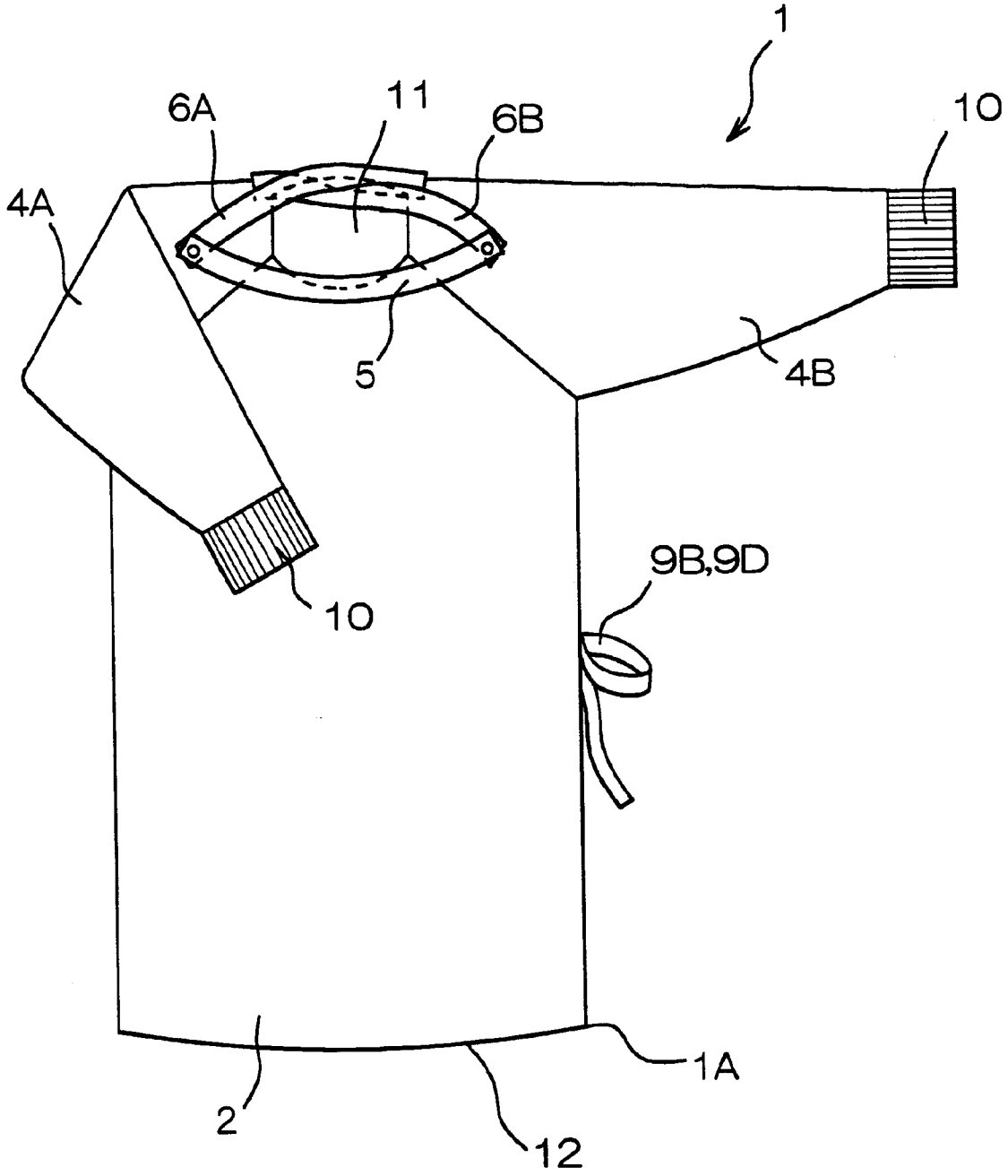
FIG. 2 is a perspective view showing the disposable gown as put on a wearer's body and viewed from the front trunk region.
Figure 3:
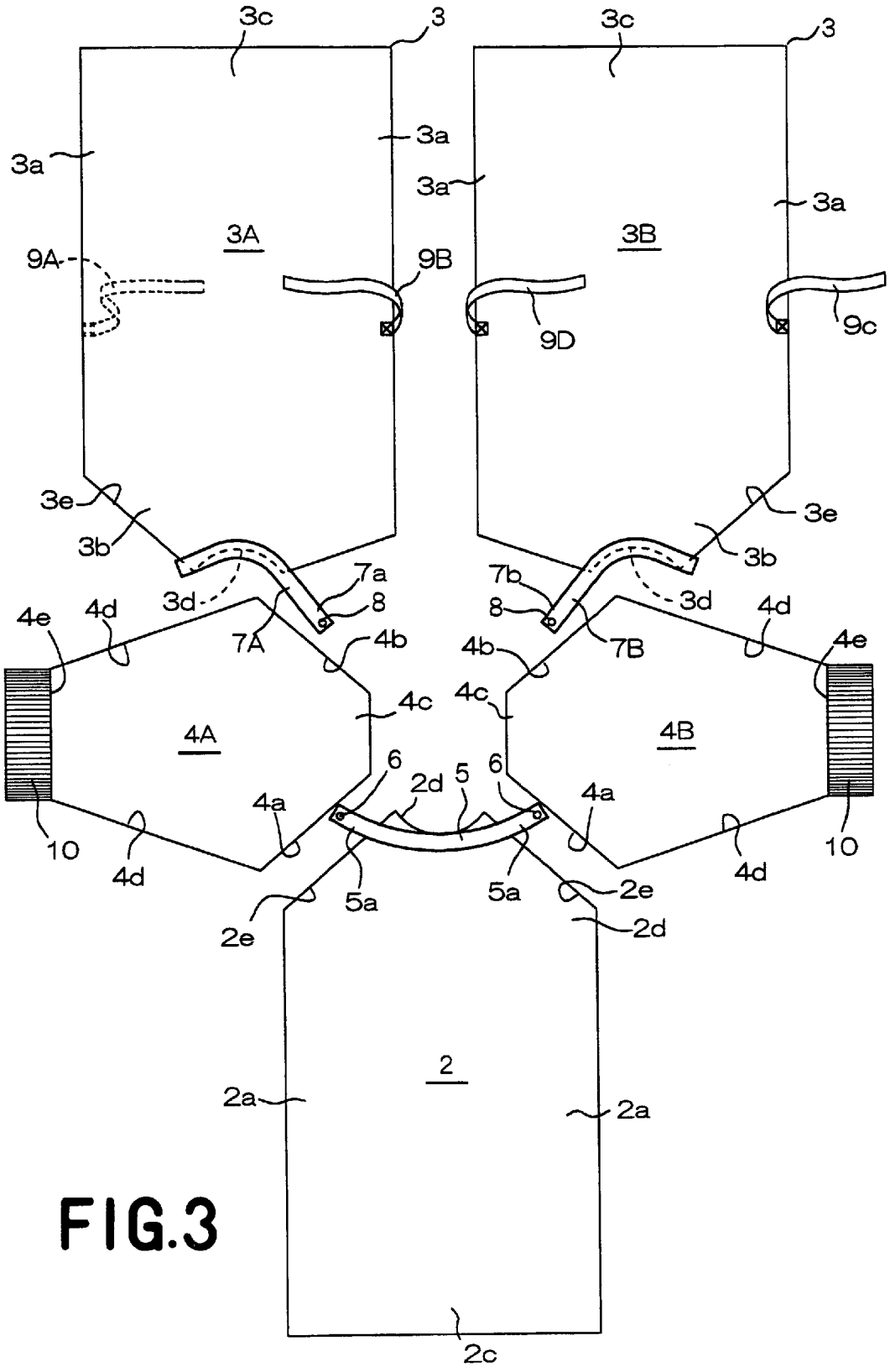
FIG. 3 is an exploded plan view of the gown of FIG. 1.
Figure 4:
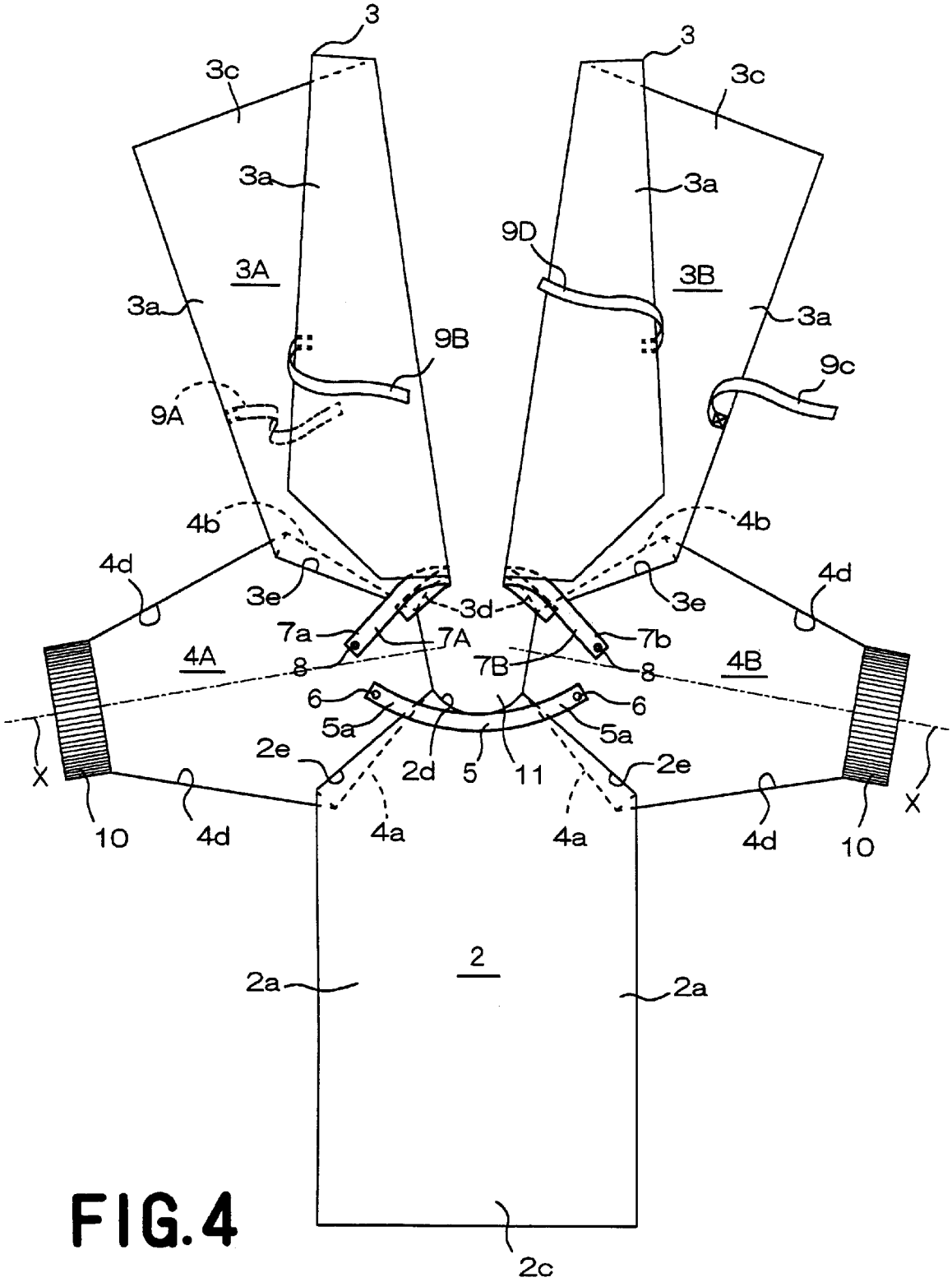
FIG. 4 is an assembled view showing the gown of which the basic trunk portion and the sleeves are bonded together from the state illustrated in the exploded plan view of FIG. 3.

FIGS. 1 and 2 are perspective views showing a disposable gown 1 as viewed from a front trunk region 2, FIG. 3 is an exploded plan view of the gown of FIG. 1, and FIG. 4 is an assembled view showing the gown 1 of which a basic trunk portion 1A and sleeves 4A and 4B are bonded together from the state illustrated in the exploded plan view of FIG. 3. FIG. 2 shows the gown 1 of which a front collar member 5, first and second rear collar members 7A, 7B are engaged each other and respective pairs of tying cords 9A, 9B, 9C, 9D for waist portion are fastened each other.

The gown is basically composed of the basic trunk portion 1A and the both sleeves 4A, 4B attached to the upper end of the basic trunk portion 1A. In the gown 1, a neck opening 11 is formed between the both sleeves 4A, 4B in the upper end region of basic trunk portion 1A, and a hem opening 12 is formed at the lower end region of the basic trunk portion 1A.

The basic trunk portion 1A has a front trunk region 2 covering wearer's breast and belly and a rear trunk region 3 covering wearer's back, each separately prepared. The rear trunk region 3 is formed from a first rear trunk half 3A connected with one side edge 2*a* of the front trunk region 2 and a second rear trunk half 3B connected with the other side edge 2*a* of the front trunk regions. Each of the sleeves 4A, 4B defines a cylindrical form tapered from a sleeve bonding region 4*a* to a cuff 4*e*. A ribbed member 10 is attached to each cuff 4*e* of the sleeves 4A, 4B. The ribbed member 10 is elastically stretchable in the circumferential direction of the sleeves 4A, 4B.

Referring to FIG. 3, the front trunk region 2 has the both side edges 2*a* longitudinally extending parallel to each other, and upper and lower ends 2*b*, 2*c* transversely extending parallel to each other. A neckline 2*d* is formed substantially in the middle of the upper end 2*b* of the front trunk region 2, and armholes 2*e* are formed on the both sides of the neckline 2*d*. The neckline 2*d* describes a circular arc so that it is convexly curve in the direction of the lower end 2*c* of the front trunk region 2. The armholes 2*e* obliquely and rectilinearly extend downward from the both sides of the neckline 2*d* to the both side edges 2*a* of the front trunk region 2.

A front collar member 5 surrounding a front half of the neck opening 11 is bonded to the neckline 2*d* of the front trunk region 2 along the edge of the neckline 2*d*. The front collar member 5 defines a transversely long belt-like form, and extends from the middle of the upper end 2*d* of the front trunk region 2 toward the both side edges 2*a*. A male press button 6 is attached to each end 5*a* of the front collar member 5 placed on the both side edges 2*a*.

The first rear trunk half 3A and the second rear trunk half 3B are identical to each other in shape as well as in size. Each of the both rear trunk halves 3A, 3B has both side edges 3*a* longitudinally extending parallel to each other and upper and lower ends 3*b*, 3*c* transversely extending parallel to each other. The both rear trunk halves 3A, 3B are so large that they may cover substantially the wearer's whole back.

A neckline 3*d* is formed substantially in the middle of the upper end 3*b* of the first rear trunk half 3A and an armhole 3*e* is formed between the neckline 3*d* and the associated one of side edges 3*a*. The neckline 3*d* describes a circular arc so that it is convexly curved in the direction of a lower end 3*c* of the first rear trunk half 3A and extends transversely. The armhole 3*e* obliquely and rectilinearly extends downward from the neckline 3*d* to the side edge 3*a* of the first rear trunk half 3A.

A first rear collar member 7A surrounding substantially the rear half of the neck opening is bonded to the neckline 3*d* of the first rear trunk half 3A along the edge of the neckline 3*d*. The first rear collar member 7A defines a transversely long belt-like form, and extends from the first rear trunk half 3A toward the second rear trunk half 3B. A female press button 8 is attached to the end 7*a* of the rear collar member 7A which faces the second rear trunk half 3B.

The first rear trunk half 3A has a pair of tying cords 9A, 9B for waist portion by means of which the rear area may be kept closed. The tying cords 9A, 9B for waist portion have their one ends attached to outer surface and inner surface of the first rear trunk half 3A, respectively, in the vicinity of each side edge 3*a* at a level corresponding to the waist line of the first rear trunk half 3A.

A neckline 3*d* is formed substantially in the middle of the upper end 3*b* of the second rear trunk half 3B and an armhole 3*e* is formed between the neckline 3*d* and the associated one of the side edges 3*a*. The neckline 3*d* describes a circular arc so that it is convexly curved in the direction of a lower end 3*c* of the second rear trunk half 3B and extends transversely. The armhole 3*e* obliquely and rectilinearly extends downward from the neckline 3*d* to the side edge 3*a* of the second rear trunk half 3B.

A second rear collar member 7B surrounding substantially the rear half of the neck opening is bonded to the neckline 3*d* of the second rear trunk half 3B along the edge of the neckline 3*d*. The second rear collar member 7B defines a transversely long belt-like form, and extends from the second rear trunk half 3B toward the first rear trunk half 3A. A female press button 8 is attached to the end 7*b* of the rear collar member 7B which faces the first rear trunk half 3A.

The second rear trunk half 3B has a pair of tying cords 9C, 9D for waist portion by means of which the rear area may be kept closed. Each of the tying cords 9C, 9D for waist portion has its one end attached to outer surface of the second rear trunk half 3B in the vicinity of the side edge 3*a* at level corresponding to the waist line of the second rear trunk half 3B.

The sleeves 4A, 4B have first sleeve bonding regions 4*a* which extend parallel to the respective first armholes 2*e* of the front trunk region 2 and second sleeve bonding regions 4*b* which extend parallel to the respective armholes 3*e* of the first and second rear trunk halves 3A, 3B. The first sleeve bonding regions 4*a* rectilinearly and obliquely extends downward from respective centers of the shoulder covering areas 4*c* to the trunk facing areas 4*d*. The second sleeve bonding regions 4*b* also rectilinearly and obliquely extend downward from the respective centers of the shoulder covering areas 4*c* to the trunk facing area 4*d*.

Referring now to FIG. 4, in the gown 1, the armholes 2*e* of the front trunk region 2 are put in coincidence with the respective first sleeve bonding regions 4*a* of the sleeves 4A, 4B while the respective armholes 3*e* of the first and second rear trunk halves 3A, 3B are put in coincidence with the respective second sleeve bonding regions 4*b* of the sleeves 4A, 4B. From this state, the sleeves 4A, 4B are bonded to the front region 2, on one hand, and to the first and second rear trunk halves 3A, 3B, on the other hand.

In the gown 1, the neckline 2*d* of the front trunk region 2 is spaced apart from the necklines 3*d* of the first and second rear trunk halves 3A, 3B by a desired dimension. Between the respective necklines 2*d*, 3*d* of the front trunk region 2 and the rear trunk halves 3A, 3B, sections of the sleeve bonding regions 2*a*, 2*b* of the sleeves 4A, 4B extend which are not bonded to armholes 2*e*, 3*e* of the front trunk region 2 and the rear trunk halves 3A, 3B.

From the state shown by FIG. 4, the front trunk region 2 and the first and second rear trunk halves 3A, 3B are folded along the centerline X extending on the both sleeves 4A, 4B so that inner surfaces of the region 2 and the halves 3A, 3B are placed upon each other. With the region 2 and halves 3A, 3B placed upon each other, the both side edges 2*a* of the front trunk region 2 may be bonded to the respective side edges 3*a* of the first and second trunk halves 3A, 3B and the respective trunk facing areas 4*d* of the sleeves 4A, 4B may be bonded together to obtain the gown 1 of FIG. 1.

It is preferable in the gown 1 to bond the outer surfaces of the respective sleeve bonding regions 4*a*, 4*b* of the sleeves 4A, 4B to the outer surfaces of the front trunk region 2 and the first and second rear trunk halves 3A, 3B with the armholes 2*e*, 3*e* of the trunk region 2 and trunk halves 3A, 3B being folded a little toward inner surfaces of the trunk region 2 and the trunk halves 3A, 3B. It is preferable also to bond the outer surfaces of the trunk region 2 and the trunk halves 3A, 3B one to another with the both side edges 2*a*, 3*a* of the front trunk region 2 and the rear trunk halves 3A, 3B facing one another being folded a little toward inside of the trunk region 2 and the trunk halves 3A, 3B.

In order to wear the gown 1, a wearer puts the both arms through the sleeves 4A, 4B of the gown 1, fastens the tying cord 9A for waist portion attached to the inner surface of the first rear trunk half 3A and the tying cord 9D for waist portion attached to the outer surface of the second rear trunk half 3B to each other, and places the second rear trunk half 3B on the outer surface of the first rear trunk half 3A. After the rear trunk halves 3A, 3B have been placed upon each other, the wearer closes the rear area by fastening the tying cord 9B for waist portion attached to the outer surface of the first rear trunk half 3A and the tying cord 9C for waist portion attached to the outer surface of the second rear trunk half 3B to each other. And then, the wearer guides the first rear collar member 7A toward the second rear trunk half 3B so that the collar member 7A is put around the neck, engages the press button 8 attached to the end 7*a* of the first rear collar member 7A with the press button 6 attached to one end 5*a* of the front collar member 5, guides the second rear collar member 7B toward the first rear trunk half 3A so that the second rear collar member 7B is put around the neck, and engages the press button 8 attached to the end 7*b* of the second rear collar member 7B with the press button 6 attached to the other end 5*a* of the front collar member 5.

Figure 5:
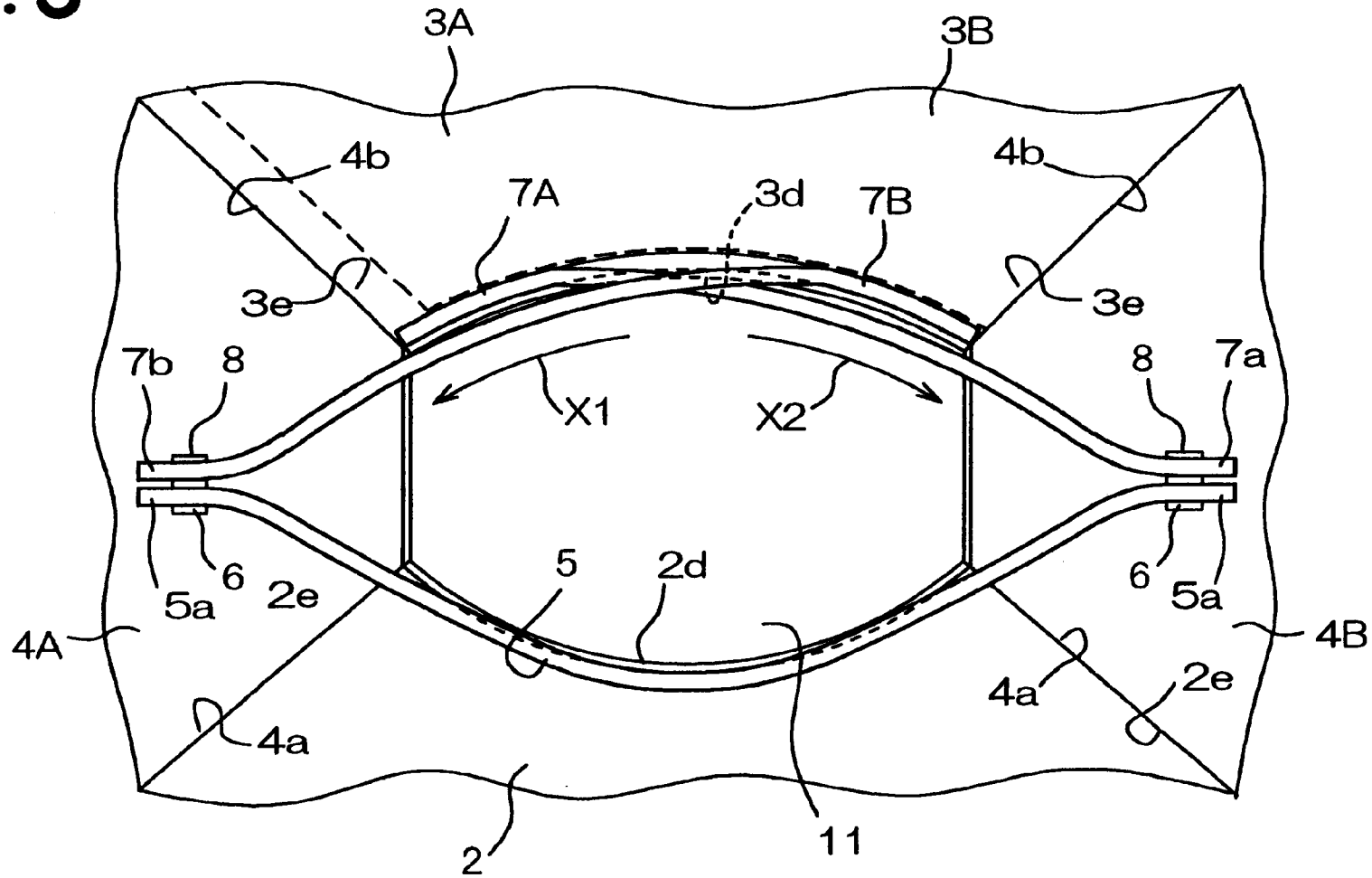
FIG. 5 is a fragmentary top view of the gown of FIG. 1 showing the collar members in enlarged scale.

FIG. 5 is fragmentary top of the gown 1 of FIG. 1 showing the collar members 6, 7A, 7B in enlarged scale. In the gown 1, the front collar member 6 and the both second rear collar members 7A, 7B engaged each other can move in the circumferential direction of the neck opening 11 as indicated by arrows X1, X2. Consequently, an enough area is ensured between the neckline 2*e*, 3*e* of the basic trunk portion 1A and the wearer's neck. Therefore, even if the wearer wearing the gown 1 stretches forward the arms or bends the elbows, extension of the collar members 6, 7A, 7B relieves the wearer of tension from each of the sleeves 4A, 4B, and prevents the tension from each of the sleeves 4A, 4B from being transmitted to upper side of the first and second rear trunk halves 3A, 3B.

A hydrophobic nonwoven fabric of thermoplastic fiber or a laminated sheet of hydrophobic nonwoven fabric and a flexible thermoplastic synthetic resin sheet can be used for the basic trunk portion 1A and the both sleeves 4A, 4B. As the laminated sheet, it is preferable to use the laminated sheet, in which both sheet surfaces of the thermoplastic synthetic resin sheet are sandwiched between two layers of hydrophobic nonwoven fabric, and the hydrophobic nonwoven fabric and the synthetic resin sheet are intermittently bonded to each other at bonding spots in the form of dots or stripes. It is possible to use a plastic sheet, for example, of polyethylene, polypropylene, polyethylene terephthalate or polyester as the synthetic resin sheet.

The nonwoven fabric made porous to improve moisture-permeability, the nonwoven fabric embossed to improve cushioning property, the nonwoven fabric provided having a stretchability, or combination thereof can be also used as the nonwoven fabric for the basic trunk portion 1A and the both sleeves 4A, 4B. It is also possible to use composite nonwoven fabric in which both sheet surfaces of a meltblown nonwoven fabric sheet having high water resistance are sandwiched between sheet surfaces of spunbond nonwoven fabric sheets having high strength and flexibility.

It is possible to use hydrophilic nonwoven fabric in which the hydrophobic nonwoven fabric of thermoplastic fiber is provided with hydrophilic treatment for the front collar member 5 as well as for the first and second rear collar members 7A, 7B.

The nonwoven fabric of spunlace-, needlepunch-, meltblown-, thermalbond-, spunbond- or chemicalbond-type can be used. Polyolefine-, polyester-, or polyamide-based fiber or conjugate fiber of thick-and-thin type or side-by-side type of polyethylene/polypropylene or polyester can be used as component fiber of a nonwoven fabric.

Instead of press buttons 6, 8, a hook member and a loop member of a mechanical fastener can be attached to each end 5*a*, 7*a*, 7*b* of the front collar member 5, the first and second rear collar members 7A, 7B. In this case, one of the hook member and the loop member can be attached to each end 5*a* of the front collar member 5, the other can be attached to each end 7*a*, 7*b* of the first and second rear collar members 7A, 7B.

In the gown 1, the basic trunk portion 1A is formed from the front trunk region 2 and the rear trunk region 3, separately prepared. However, it is also possible to form the front trunk region 2 and the rear trunk region 3 in one-piece, just like the gown 1 disclosed in Japanese Patent Publication No. 1994-207301A, and to bisect the rear trunk region 3 along the longitudinal centerline. Hot melt adhesive or technique of heat-sealing can be used for bonding of the front trunk region 2 and the rear trunk halves 3A, 3B, bonding of the front trunk region 2, the rear trunk halves 3A, 3B and the both sleeves 4A, 4B, bonding of cords 9A, 9B, 9C, 9D and bonding of sleeve ribbed members 10.

The gown 1 is used mainly as outerwear for surgeons and patients or sleepwear for patients. Each size, for example, S, M, L, LL can be provided in consideration of the shape of a wearer's body. The gown 1 is sterilized by organic gasifiable chemicals, for example ethyleneoxide, electronic beam, or radiation, after it has been put into a sterilizing bag.

The disposable gown according to the invention is uniquely configured so that the front collar member, the first and second rear collar members can move in circumferencial direction of the neck opening when the neck opening of the gown is closed by the front collar member attached to the front trunk region and the first and second rear collar member attached to the first and second rear trunk halves. Consequently, an enough area is ensured between the neck line of the basic trunk portion and the wearer's neck.

In the gown, even if its wearer stretches the arms forward or bends the elbows, extension of the collar members relieves the wearer of tension from each of the sleeves and can prevent the tension from each of the sleeves from being transmitted to the upper side of the first and second rear trunk halves. Therefore, no high pressure of the wear is exerted on the wearer's neck and movement of wearer's neck can be free from restriction by the upper end of the trunk portion.

What is claimed is:

1. A disposable gown comprising a basic trunk portion which has a front trunk region covering the breast and belly of a wearer and a rear trunk region covering the back of the wearer, and both sleeves attached to both sides of an upper end of said basic trunk portion, with a neck opening in the upper end and a hem opening in a lower end of said basic trunk portion, wherein said rear trunk region comprises a first rear trunk half contiguous to one side edge of said front trunk region and a second rear trunk half contiguous to the other side edge of said front trunk region, wherein:

a collar element by means of which said first rear trunk half and said second rear trunk half may be kept closed extends along the edge of said neck opening in its circumferencial direction, said collar element being formed from a front collar member attached to said front trunk region and surrounding substantially front half of said neck opening, a first rear collar member attached to said first rear trunk half and extending toward said second rear trunk half so as to surround substantially a rear half of said neck opening, and a second rear collar member attached to the second rear trunk half and extending toward said first rear trunk half so as to surround substantially a rear half of said neck opening, a first pair of engaging means being formed on respective ends of said front collar member and said first rear collar member facing said second rear collar member, the first pair of engaging means detachably fastening said collar members to each other, a second pair of engaging means being formed on respective ends of said front collar member and said second rear collar member facing said first rear collar member so that the second pair of engaging means may detachably fasten said collar members to each other.

2. The gown according to claim 1, wherein said basic trunk portion and each of said sleeves are formed with a hydrophobic nonwoven fabric or a laminated sheet of hydrophobic nonwoven fabric and a flexible thermoplastic synthetic resin sheet, and said collar element is formed by a hydrophilic nonwoven fabric.

* * * * *